US006668822B2

(12) United States Patent
Monnich

(10) Patent No.: US 6,668,822 B2
(45) **Date of Patent: *Dec. 30, 2003**

(54) SNORKEL WITH IMPROVED PURGING SYSTEM

(76) Inventor: John M. Monnich, 5426 California St., #2, San Francisco, CA (US) 94118

( * ) Notice: Subject to any disclaimer, the term of this patent is extended or adjusted under 35 U.S.C. 154(b) by 39 days.

This patent is subject to a terminal disclaimer.

(21) Appl. No.: 09/999,061

(22) Filed: Oct. 31, 2001

(65) Prior Publication Data

US 2002/0088460 A1 Jul. 11, 2002

Related U.S. Application Data

(63) Continuation-in-part of application No. 09/229,193, filed on Jan. 13, 1999, now Pat. No. 6,318,363

(60) Provisional application No. 60/071,338, filed on Jan. 14, 1998.

(51) Int. Cl.[7] ..... B63C 11/16

(52) U.S. Cl. ..... 128/201.11; 128/201.27; 128/201.28

(58) Field of Search ..... 128/201.11, 201.27, 128/201.28, 204.26

(56) References Cited

U.S. PATENT DOCUMENTS

| | | | | |
|---|---|---|---|---|
| 3,218,607 | A | 11/1965 | Brock et al. | 340/5 |
| 3,268,854 | A | 8/1966 | Sato | 340/4 |
| 3,292,618 | A | 12/1966 | Davis et al. | 128/142 |
| 3,451,039 | A | 6/1969 | Epstein et al. | 340/5 |
| 3,603,306 | A | 9/1971 | Bonin, Jr. | 128/145 |
| 3,736,551 | A | 5/1973 | Hirsch | 340/5 |
| 3,789,353 | A | 1/1974 | Hunter et al. | 340/5 |
| 3,860,042 | A | 1/1975 | Green | 128/145 |
| 4,039,999 | A | 8/1977 | Hill | 128/145 |
| 4,071,024 | A | 1/1978 | Blanc | 128/145 |
| 4,230,106 | A | 10/1980 | Geeslin et al. | 128/201.11 |
| 4,269,182 | A | 5/1981 | Le | 128/201.11 |
| 4,276,623 | A | 6/1981 | Abbott | 367/132 |
| 4,278,080 | A | 7/1981 | Schuch | 128/201.11 |
| 4,380,232 | A | 4/1983 | Doyle | 128/201.11 |

(List continued on next page.)

FOREIGN PATENT DOCUMENTS

| | | | |
|---|---|---|---|
| FR | 2 723 064 | 2/1996 | B63C/11/16 |
| FR | 2 791 948 | 10/2000 | B63C/11/16 |
| WO | WO 91/17916 | 11/1991 | B63C/11/16 |

OTHER PUBLICATIONS

"2100 Ball, Check, Gate & Port Valves," Ewing Irrigation Products, Phoenix, Arizona, pp. 66 (advertisement).

Finis, Inc., "Fin Swimming for Recreation, Fitness, Swimming Development and Competitions—The Swimmer's Snorkel" Internet Web Site Page http://www.finis–net.com/snorkel.htm.

European Patent Office Communication and Search Report dated Feb. 15, 2002.

*Primary Examiner*—Aaron J. Lewis
(74) *Attorney, Agent, or Firm*—Stallman & Pollock LLP

(57) ABSTRACT

A snorkel for use in swimming. The snorkel includes an elongate breathing tube having an upper portion and a lower portion. A lower opening is formed in the lower portion and an upper opening is formed in the upper portion. A mouthpiece is located at the lower opening of the snorkel. A one-way valve is disposed in the lower portion and is oriented to prevent the flow of fluids into the lower portion, but to permit the flow of gases and fluids out of the lower portion. A check valve is disposed in the upper portion. The check valve includes a plate pivotable from an open position permitting airflow through the upper opening, to a closed position preventing airflow through the upper opening. A spring member contacts the plate, biasing the plate in the open position.

27 Claims, 15 Drawing Sheets

U.S. PATENT DOCUMENTS

| | | | | |
|---|---|---|---|---|
| 4,610,246 | A | 9/1986 | Delphia | 128/201.11 |
| 4,655,212 | A | 4/1987 | Delphia | 128/201.11 |
| 4,708,135 | A | 11/1987 | Arkema | 128/201.11 |
| 4,782,830 | A | 11/1988 | Forman | 128/201.11 |
| 4,799,263 | A | 1/1989 | Banziger et al. | 381/94 |
| 4,805,610 | A | 2/1989 | Hunt | 128/201.11 |
| 4,834,084 | A | 5/1989 | Walsh | 128/201.11 |
| 4,877,022 | A | 10/1989 | Christianson | 128/201.11 |
| 4,878,491 | A | 11/1989 | McGilvray, III | 128/201.11 |
| 4,879,995 | A | 11/1989 | Christianson | 128/201.11 |
| 4,884,564 | A | 12/1989 | Lamont | 128/201.11 |
| 4,896,664 | A | 1/1990 | Harayama | 128/200.25 |
| 4,928,710 | A | 5/1990 | Campbell | 128/861 |
| 5,092,324 | A | 3/1992 | Christianson | 128/201.11 |
| D328,959 | S | 8/1992 | Greatrake et al. | D29/7 |
| 5,143,059 | A | 9/1992 | Delphia | 128/201.11 |
| 5,199,422 | A | 4/1993 | Rasocha | 128/201.11 |
| D335,322 | S | 5/1993 | Jones | D21/236 |
| 5,239,990 | A | 8/1993 | Delphia | 128/201.11 |
| D339,399 | S | 9/1993 | Lin | D21/236 |
| D339,400 | S | 9/1993 | Lin | D21/236 |
| 5,261,396 | A | 11/1993 | Faulconer et al. | 128/201.11 |
| 5,267,556 | A | 12/1993 | Feng | 128/201.11 |
| 5,280,785 | A | 1/1994 | Fujima | 128/201.11 |
| 5,404,872 | A | 4/1995 | Choi | 128/201.11 |
| 5,438,977 | A | 8/1995 | Gomez et al. | 128/202.14 |
| 5,487,379 | A | 1/1996 | Koshiishi | 128/201.11 |
| 5,493,079 | A | 2/1996 | Anderson | 181/127 |
| 5,529,057 | A | 6/1996 | Ferrero et al. | 128/201.11 |
| 5,657,746 | A | 8/1997 | Christianson | 128/201.11 |
| 5,664,558 | A | 9/1997 | Wagner | 128/201.11 |
| 5,671,728 | A | 9/1997 | Winefordner et al. | 128/201.11 |
| 5,697,362 | A | 12/1997 | Albrecht | 128/201.11 |
| 5,845,635 | A | 12/1998 | Hermansen et al. | 128/201.11 |
| 5,865,169 | A | 2/1999 | Lan et al. | 128/201.11 |
| 5,868,129 | A | 2/1999 | Christianson | 128/201.11 |
| 6,085,744 | A | 7/2000 | Hermansen et al. | 128/201.11 |
| 6,129,081 | A * | 10/2000 | Wu | 128/201.11 |
| 6,202,644 | B1 * | 3/2001 | Takeuchi et al. | 128/201.11 |
| 6,302,102 | B1 * | 10/2001 | Giroux et al. | 128/201.11 |
| 6,318,363 | B1 * | 11/2001 | Monnich | 128/201.28 |
| 6,371,108 | B1 * | 4/2002 | Christianson | 128/201.11 |
| 6,516,797 | B2 * | 2/2003 | Chen-Lieh | 128/201.11 |

* cited by examiner

SNORKEL WITH IMPROVED PURGING SYSTEM

CROSS-REFERENCE TO RELATED APPLICATION(S)

This application is a continuation in part of application Ser. No. 09/229,193,filed Jan. 13, 1999 now U.S. Pat. No. 6,318,363 which claims the benefit of Provisional Application No. 60/071,338, filed Jan. 14, 1998, both entitled "HYDRODYNAMIC AND ERGONOMIC SNORKEL", of which is hereby incorporated by reference for all purposes.

FIELD OF THE INVENTION

This invention relates generally to the field of water snorkels for swimming and diving, and particularly to a snorkel having an enhanced system for restricting entrance of water into, and the purging of water from, the breathing tube during use.

BACKGROUND OF THE INVENTION

The use of a breathing tube to allow a swimmer to maintain facial position below the surface of the water is well known. Snorkels are useful in clear water to allow observation of underwater plant and animal life.

A swimmer will stroke with ideal efficiency when his or her face is in the water, but the back of the head remains out of the water. Many swimmers find breathing difficult while maintaining ideal stroke form, as pushing the chin forward to lift the back of the head out of the water creates a strain in the trachea.

Moreover, when a swimmer raises his or her head to breathe, the hips and legs sink into the water. A two-inch vertical lift of the head can result in a four-to six-inch drop of the hips, and a corresponding eight- to twelve-inch drop of the feet. This departure from ideal stroke form can double the frontal surface area offered to the water, thereby doubling the water resistance encountered by the swimmer.

Because a snorkel allows the swimmer to breathe without raising his or her head, snorkels have been used to assist athlete's train for competition. Under these circumstances, it is important that the swimmer can easily purge water from the breathing tube during use, to prevent interruption of his/her training.

Traditional purge valve designs used for diving are not suitable for use in swimming. In order to activate a conventional diving purge valve, the reservoir surrounding the valve must be filled with water above the mouth area. When the user sharply exhales, water in the snorkel is forced upward, and provides sufficient back-pressure to offset external water pressure and activate the purge valve. Accumulated air and water are expunged, and the swimmer can breathe again.

When a scuba diver uses a snorkel, water normally fills the entire snorkel and the conventional purge valve works adequately. However, when a snorkel is used primarily for surface activities such as swimming and snorkeling, the snorkel will contain some water but will not ordinarily become filled.

The conventional diving-type purge valve is thus unsuited for swimming and snorkeling, as a relatively large volume of water must accumulate in the snorkel before it can be purged. This accumulated water consumes valuable air space, decreasing the flow of air available to the swimmer. Accumulated water can also splash into the swimmer's airway, making breathing uncomfortable.

There is thus a need in the art for a snorkel design that permits a swimmer to efficiently purge the snorkel of water during use, without having to wait for the snorkel to fill with a relatively large volume of water.

SUMMARY OF THE INVENTION

The present invention is a snorkel, which includes an elongate breathing tube having an upper portion and a lower portion. A lower opening is formed in the lower portion and an upper opening is formed in the upper portion. A mouthpiece is located at the lower opening of the snorkel.

A one-way valve is disposed in the lower portion and is oriented to prevent the flow of fluids into the lower portion, but to permit the flow of gases and fluids out of the lower portion. A check valve is disposed in the upper portion. The check valve includes a plate pivotable from an open position permitting airflow through the upper opening, to a closed position preventing airflow through the upper opening. A spring member contacts the plate, biasing the plate in the open position.

BRIEF DESCRIPTION OF THE DRAWINGS

FIG. 5B schematically shows the valve as it is pushed open by sharp exhalation by the user.

In FIG. 7A the spring is positioned to provide the plate with increased resistance against pivoting to the closed position. In FIG. 7B the spring is positioned for reduced resistance of the plate against pivoting and thus for easier purging of the system.

DETAILED DESCRIPTION

Figure 1A:
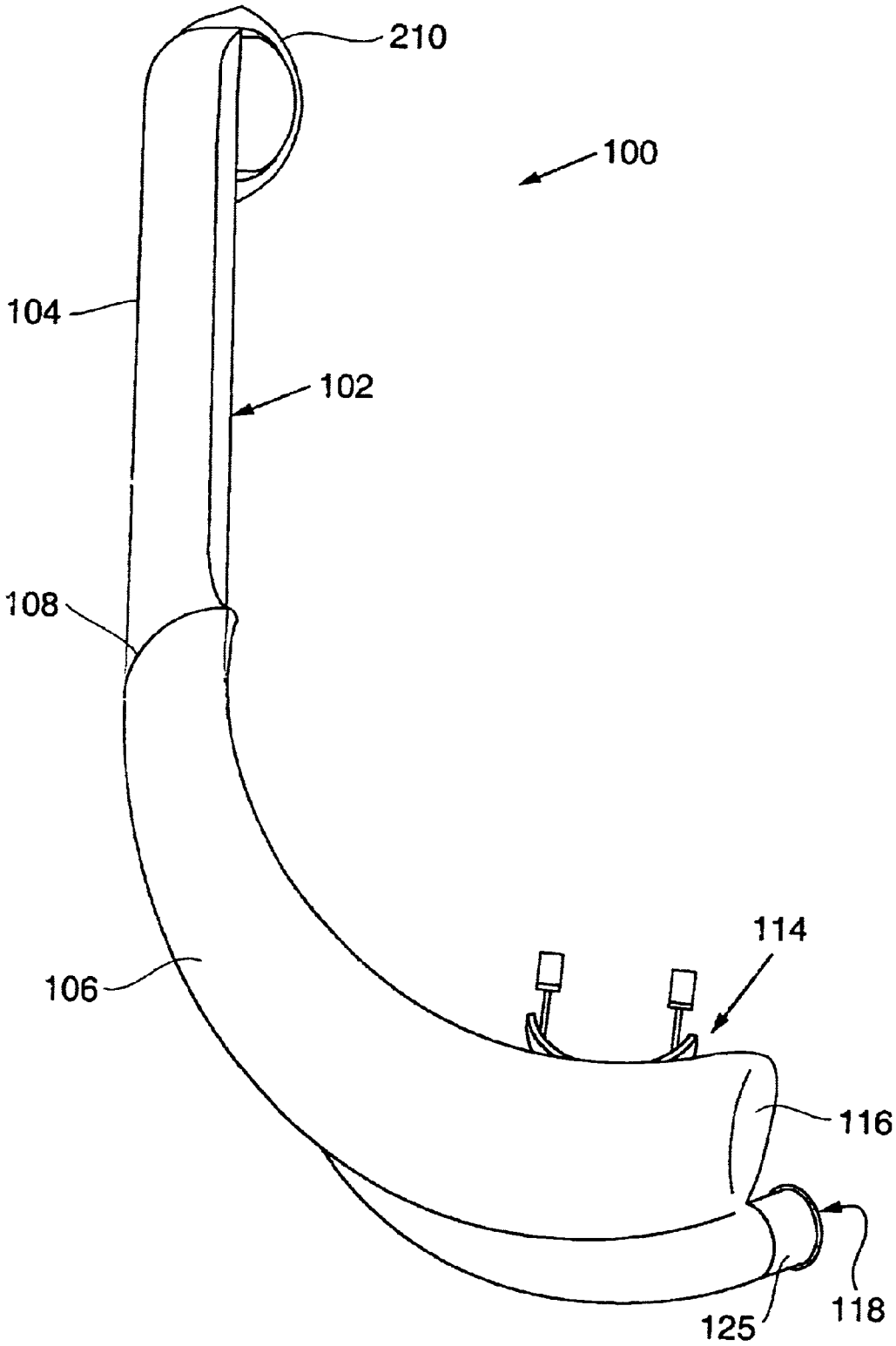
FIG. 1A shows a perspective view a snorkel utilizing principles of the present invention.
Figure 1B:
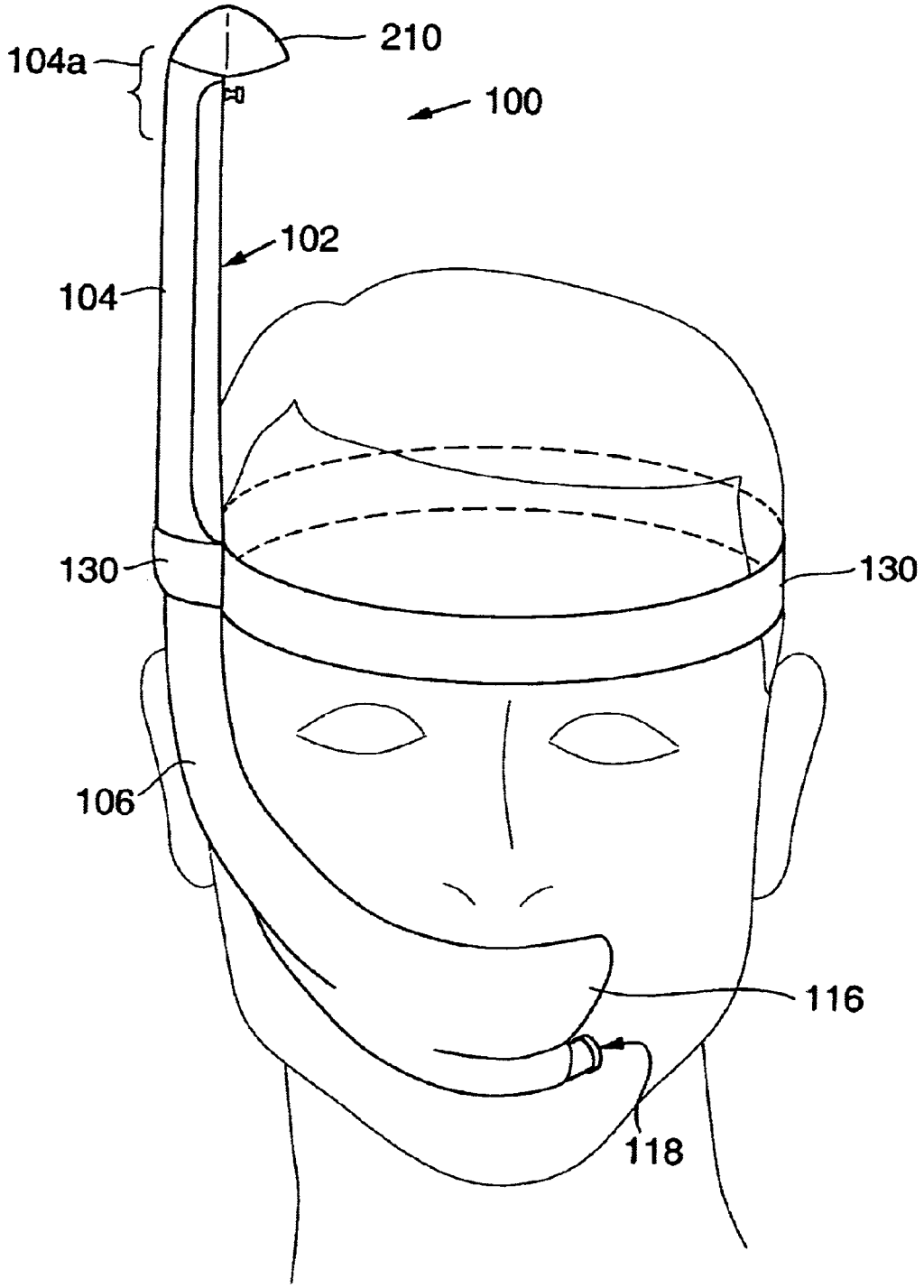
FIG. 1B is a front perspective view of the snorkel of FIG. 1A, showing the snorkel secured to a swimmer's head.

FIGS. 1A and 1B show a snorkel in accordance with a first embodiment of the present invention. Snorkel 100 includes a hollow breathing tube 102 that includes an upper portion 104 and a lower portion 106 which meet at junction 108. Snorkel 100 may be secured to the head of a user by thin, adjustable rubber strap 130 (FIG. 1B) having a simple clasp. When worn, the snorkel tube may extend along the side of the swimmers head as shown, or it may be in another position, such as along the central axis of swimmers face.

Lower portion 106 of breathing tube 102 is constructed from a soft plastic shell of lightweight and flexible material such as polyurethane. A flexible mesh is preferably embedded in the polyurethane to provide support for lower portion 106. A series of internal ribs or other metal support (rigid or flexible) may alternatively be utilized for providing support to the lower portion.

Because the shell and mesh are composed of flexible materials, the shape of lower portion 106 can readily be adjusted to conform to the contour of the face of a particular user. Moreover, the lower portion 106 can be fabricated utilizing a mold in the general shape of a face. Molds of various sizes can be utilized to model the faces of children, adolescents, and adults.

Figure 2A:
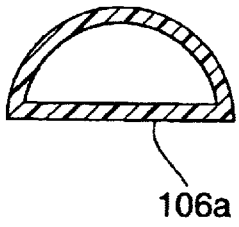
FIG. 2A shows a cross-sectional top view of the lower section of the snorkel of FIG. 1A.

Lower portion 106 of breathing tube 102 has a cross-sectional shape selected to optimize hydrodynamic efficiency of the snorkel as it moves through the water. To this end, a semi-circular, air-foil, crescent-shaped or equivalent cross-sectional shape may be utilized. The semi-circular cross-section shown in FIG. 2A is useful in that it is hydrodynamic but also may be easily bent across the straight face 106*a* to facilitate molding of the lower portion to the swimmer's face.

Figure 3:
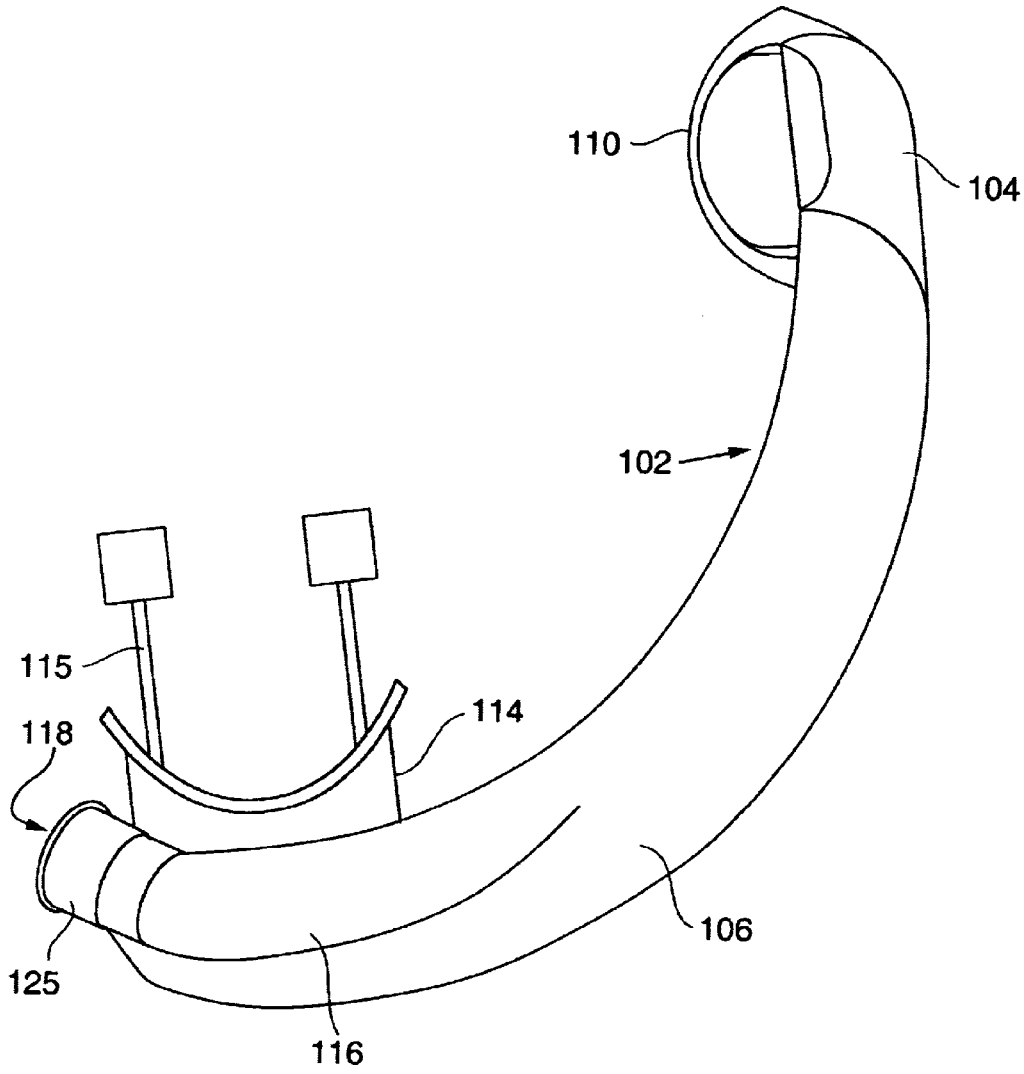
FIG. 3 is a bottom perspective view of the snorkel of FIG. 1A.

Lower portion 106 includes a mouthpiece 114 positioned in front of a breathing chamber 116, and a recessed purge valve 118. Deformable wire members 115 (FIG. 3), preferably covered in silicone rubber or plastic, are positioned on opposite sides of mouthpiece 114. Each wire member terminates in a rubber tab 117. During use, the user positions his/her lips around mouthpiece 115 and bends wire members 115 towards the insides of his/her cheeks while biting down on the silicone-covered wires to hold the snorkel in place, to further secure snorkel 100 within the mouth.

Figure 4:
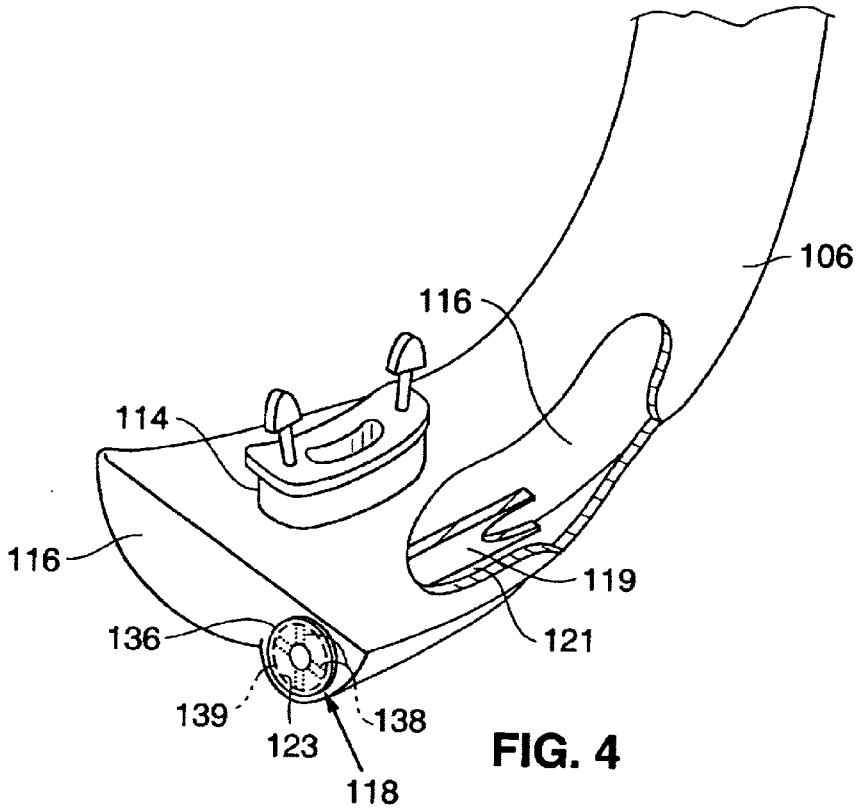
FIG. 4 is a perspective view of the lower section of the snorkel of FIG. 1A, showing the lower section partially cut away to show the interior.

FIG. 4 shows the lower portion 106 of snorkel 100. Within lower portion 106 is breathing chamber 116, which includes an interior wall 119 that partially isolates a purge chamber 121 from the rest of the breathing chamber. Purge/drainage chamber 116 terminates with an opening 123.

Figure 5A:
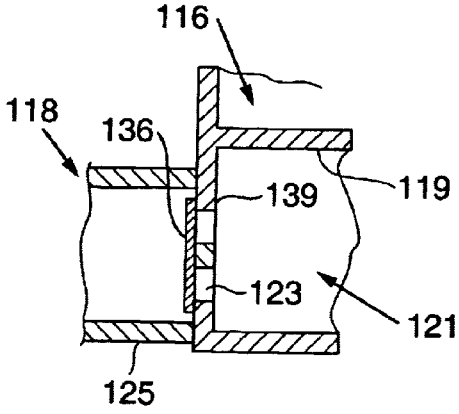
FIGS. 5A and 5B are cross-sectional side views of the purge valve of the embodiment of FIG. 1A.
Figure 5B:
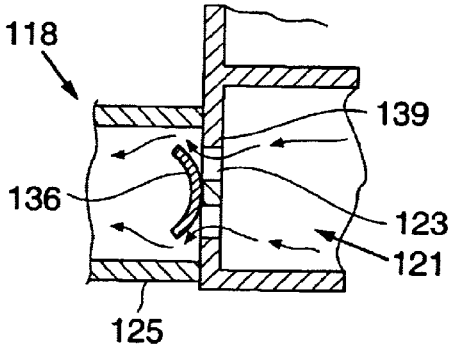

Purge valve 118 is a flexible umbrella valve having a flexible rubber flap 136 fixed at its center to the central intersection point of bars 138. The peripheral edges of flap 136 rest against the plastic perimeter 139 of the opening 123. These edges are outwardly flexible away from bars 138. When the user exhales with sufficient force to overcome the external pressure, flap 136 flexes outwardly, permitting flow of air and water out of the snorkel as shown in FIG. 5B. However, bars 138 and the plastic perimeter of the opening 121 prevent inward movement of the flap, and thus preclude the reverse flow of water or air back into the snorkel. An external tube 125 (not shown in FIG. 4, see FIG. 3) surrounds the purge valve 118 on the exterior of the device so as to prevent flexure of flap 136 in response to outside water movement.

Figure 2B:
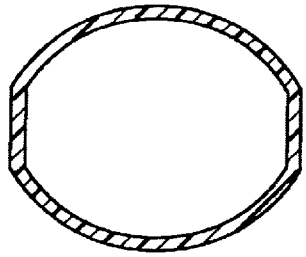
FIG. 2B shows a cross-sectional top view of the upper section of the snorkel of FIG. 1A.
Figure 2C:
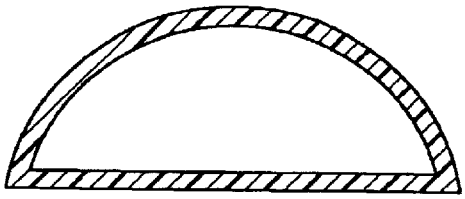
FIG. 2C shows a cross-sectional top view of the region of the upper section positioned adjacent to the cap of the snorkel of FIG. 1A.

Referring to FIG. 1A, upper portion 104 of breathing tube 102 is constructed from hard and stiff injection-molded plastic. An opening 105 (FIGS. 6A and 8A) is formed at the top of upper portion 104. Along most of its length, upper portion 104 is shaped for hydro dynamically efficient movement through the water, and may have an oval cross-sectional shape as shown in FIG. 2B, or alternatively an "air-foil", semi-circular, or equivalent shape. In the region 104*a* just below opening 105, the cross-section preferably tapers to the semi-circular shape shown in FIG. 2C.

Figure 2D:
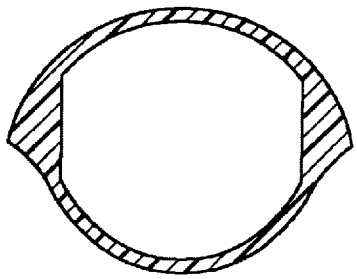
FIG. 2D is a bottom plan view of the cap of the snorkel of FIG. 1A.
Figure 8A:
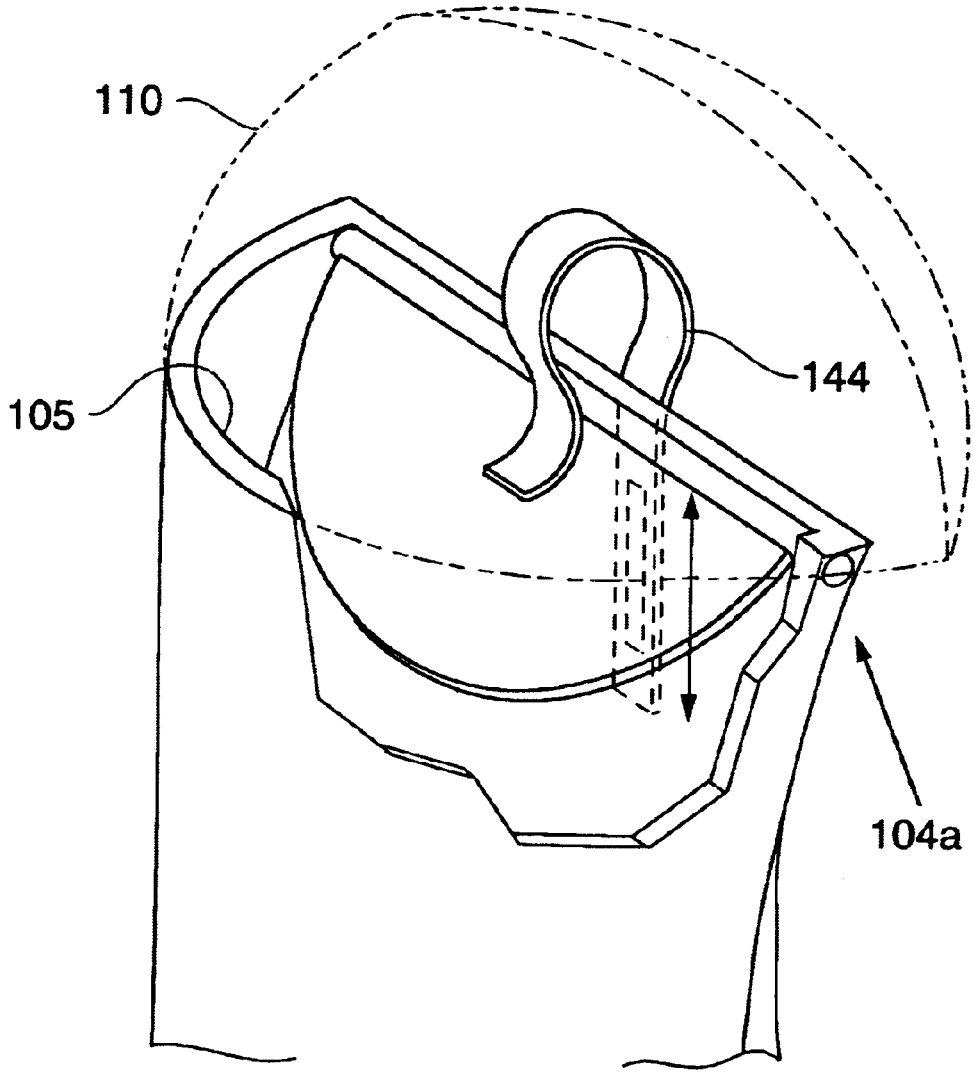
FIG. 8A is a perspective view of the check valve of the upper section of the snorkel of FIG. 1A, showing the cap in place.

A cup-shaped cap 210 (FIGS. 1A, 1B, and 8A)is mounted on the end of the upper portion 104, at the opening 105. Cap 210 is oriented such that its opening faces downwardly. As shown in the bottom view of FIG. 2D, the bottom of cap 210 has an oval cross-section, with two large curved wall regions 210*a*, 210*b*. Since the upper portion 104 has semi-circular cross-section at the opening 105, one of the cap's curved wall 210*a* is attached to the curved wall of upper portion 104 (see FIG. 2C), and the cap's other curved wall 210*b* extends beyond the straight wall of the upper portion as shown in FIGS. 1A and 8A. This orientation of the cap prevents water splashing over the top of the snorkel from entering through upper opening 105.

Figure 1C:
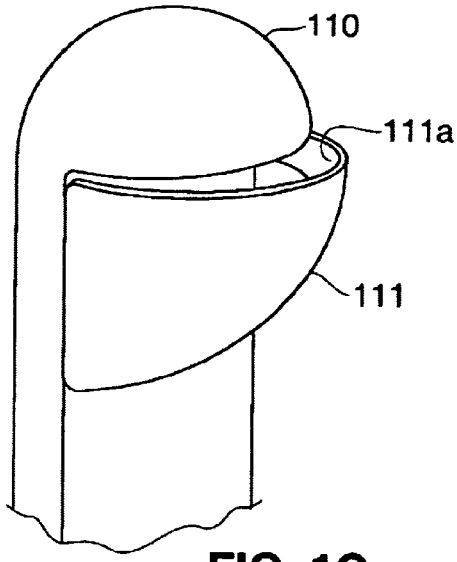
FIGS. 1C and 1D are perspective views of the upper end of the snorkel of FIG. 1A as modified to include an additional splash guard.
Figure 1D:
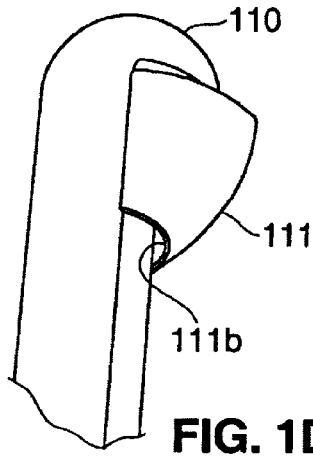

Referring to FIGS. 1C and 1D, snorkel may also include an additional splash protector 111 in the form of a cup having an upwardly-facing opening 111*a* positioned beneath cap 110. Splash protector 111 further shields the air opening from water splashes. A small opening 111*b* in the bottom of the splash protector 111 allows for drainage of any water falling into the cup.

Figure 1E:
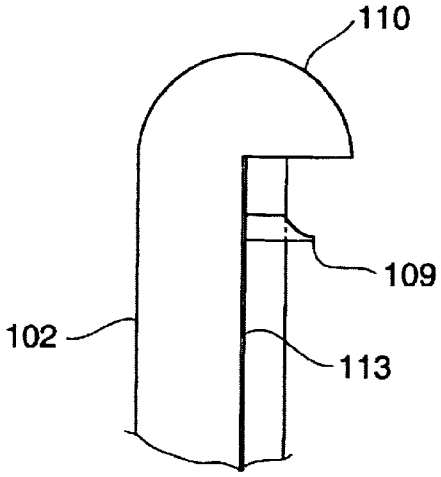
FIGS. 1E through 1G are perspective views of the upper end of the snorkel of FIG. 1A as modified to include a second variation of a splash guard.
Figure 1F:
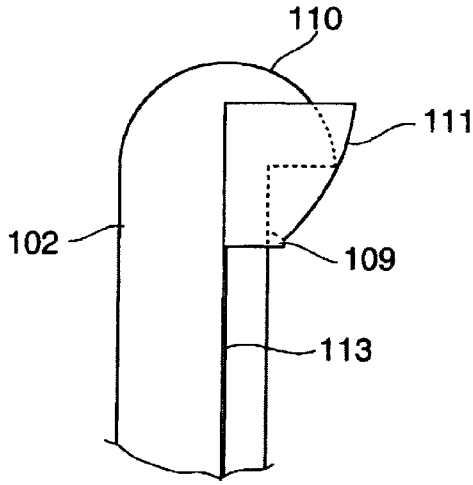
Figure 1G:
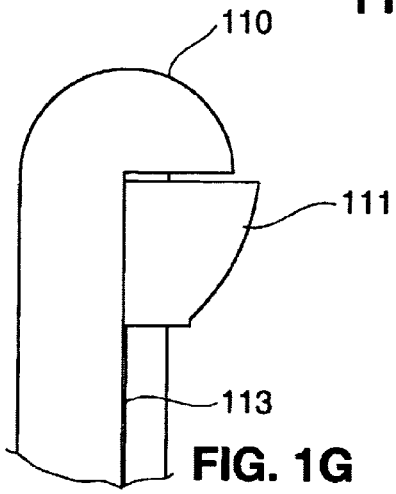

Another variation of the splash guard is shown in FIGS. 1E through 1F. In this embodiment, the splash protector 111 serves the added function of minimizing entry of water into the breathing tube 102 when the snorkel is submerged, such as during a flip turn being carried out by the swimmer. The splash protector 111 (not shown in FIG. 1E) is slidable along a track 113 formed in the side of the breathing tube 102. The splash protector 111 is slidable between the closed position shown in FIG. 1F and the open position shown in FIG. 1G. When the splash protector is in the closed position, cap 110 makes sealing contact against the interior surface of the splash protector as shown in FIG. 1F. Moreover, a sealing member 109 is positioned such that when the splash protector is in the closed position, the sealing member 109 seals against the lower opening 116 of the splash guard.

When the swimmer submerges, the splash guard slides upwardly, causing the splash protector 111 to seal against the cap 110 and the seal 109. This prevents water from entering the breathing tube 102 during submersion. When the snorkel emerges from the water, the splash guard is caused to move to the opened position (FIG. 1G) by the swimmer's exhalation and the weight of water remaining in the small reservoir formed in the splash guard 111 between the seal 109 and the cap 110.

Figure 6A:
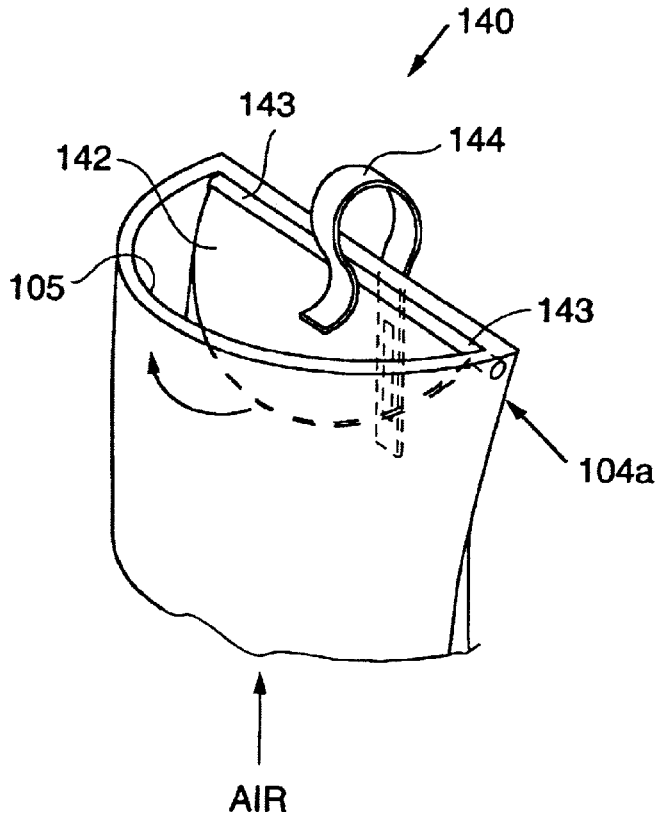
FIG. 6A is a perspective view of the uppermost section of the snorkel of FIG. 1A, showing details of the check valve. The cap is not shown for purposes of clarity.
Figure 6B:
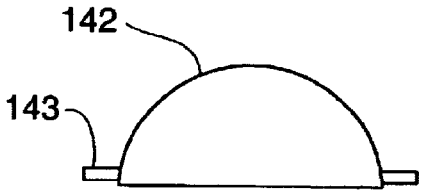
FIG. 6B is a plan view of the plate for the check valve of FIG. 6A.
Figure 6C:
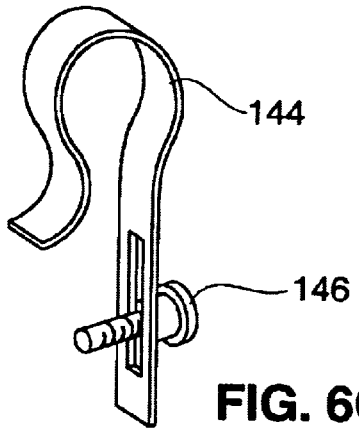
FIG. 6C is a perspective view of the spring for the check valve of FIG. 6A.

Referring to FIG. 6A, upper portion 104 includes an internal check valve 140. Internal check valve 140 is a tension-controlled valve that allows the user to create sufficient back pressure in breathing chamber 116 to drive accumulated water out of the snorkel through purge valve 118. Plate 142 of valve 140 is preferably attached by pin members 143 within the uppermost section 104*a* of upper portion 104, at the point where the cap 210 is mounted to the upper portion 104. However, the internal check valve 140 may be positioned anywhere within the tube of the upper or lower portion. Plate 142 is pivotable about the pin members 143. Plate 142 has a semi-circular shape to match the cross-section of section 104*a*.

A plastic spring member 144 is secured to the exterior of section 104*a* by thumbscrew 146 (not shown in FIG. 6A for purposes of clarity). Spring member 144 includes a free end 148 that curls into the opening 105 and contacts plate 142. In its resting state, spring member 144 pushes plate 142 downwardly into upper section 104, leaving the breathing tube unobstructed for passage of air into and out of the snorkel.

When the user wishes to clear accumulated water, the swimmer rolls to the side in the normal course of swimming and sharply exhales. This sharp exhalation pushes plate 142 upwardly against the bias of spring member 144 causing plate 142 to close the breathing tube against the passage of air in either direction. Closing check valve 140 in this manner creates an internal pressure within the snorkel that is greater than the external water pressure, allowing air and accumulated water to pass out of recessed purge valve 118.

Adjustable screw 146 allows the user to adjust the amount of spring force applied against flap 142. The user may loosen screw 146 and slide the spring 144 upwardly along the outside of upper portion 104 or withdraw the spring 144 slightly. Doing so alters the amount of resistance against rotation that the spring will place on the plate.

Figure 7A:
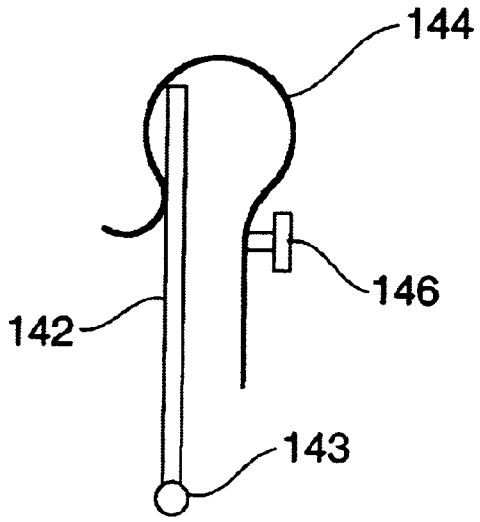
FIGS. 7A and 7B are side elevation views of the plate and spring components of the check valve assembly of FIG. 6A.

For example, an experienced, swimmer will adjust spring to move spring 144 downwardly relative to plate 142 and to thus exert pressure against the plate at a location closer to the rotation point of the plate (i.e. pins 143), as shown in FIG. 7A, so that exhalation with greater force is necessary to activate check valve 140 and purge snorkel 100.

Figure 7B:
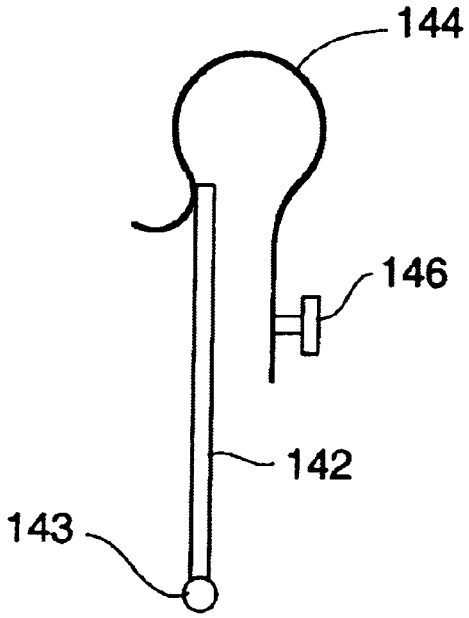

Conversely, a swimmer having less powerful exhalation will slide spring 144 upwardly relative to breathing tube 102 and plate 142. In this position (FIG. 7B), the spring contacts plate 142 at a point relatively far from the pin 143 about which plate 142 rotates, so that less breath pressure will be needed to drive flap 142 into the closed position.

Figure 8B:
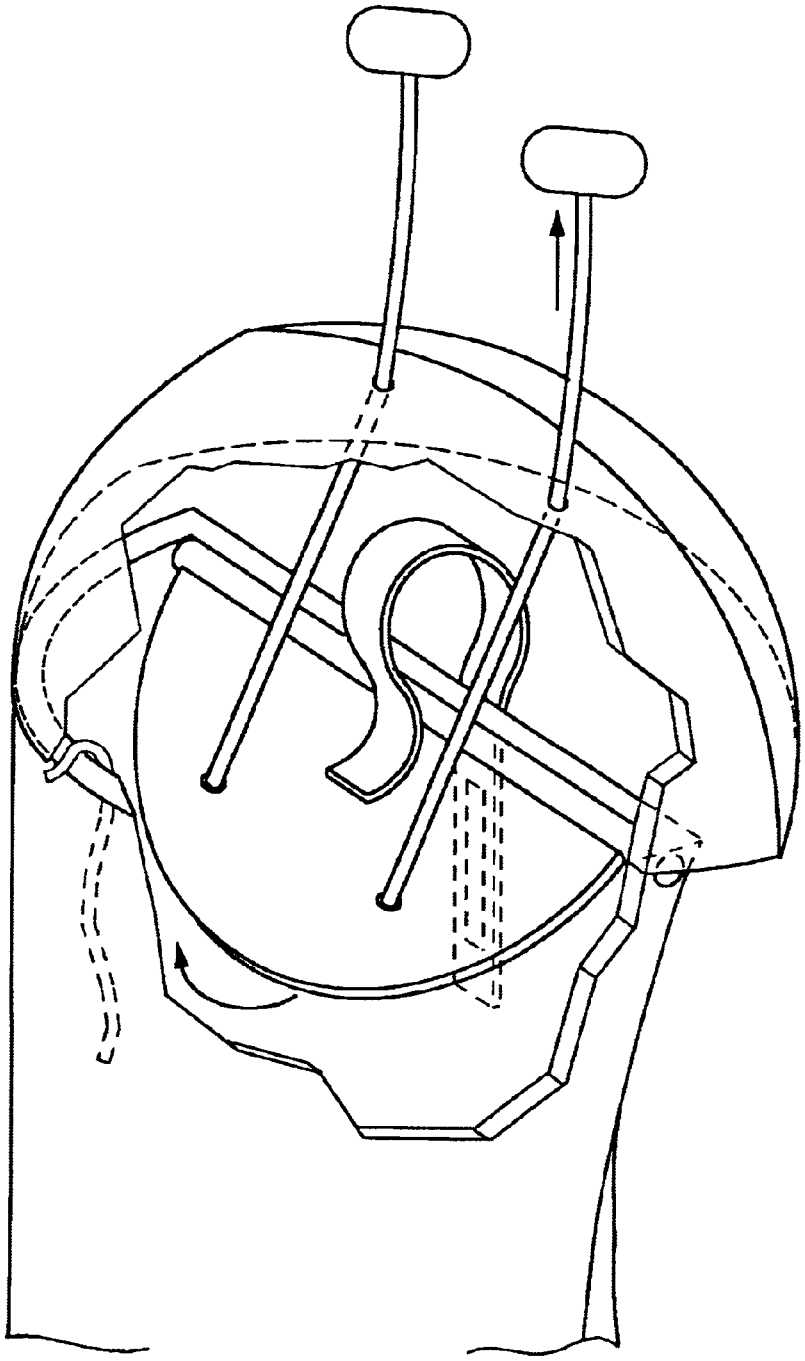
FIG. 8B is a perspective view similar to FIG. 8A and further showing floats that may be included.

Referring to FIG. 8B, one or more floats 152 may be connected to rods 154 coupled to plate 142 and extending through slits 156 in cap 110. A spring 158 is attached to the interior of the snorkel. When the snorkel is submerged, the floats 152 pull the plate 142 into the closed position, in which is engaged by the spring 158, thus minimizing the amount of water that flows into the breathing tube upon submersion. When the swimmer surfaces and inhales, his/her inhalation draws the check valve open by releasing plate 142 from spring 158.

Figure 9:
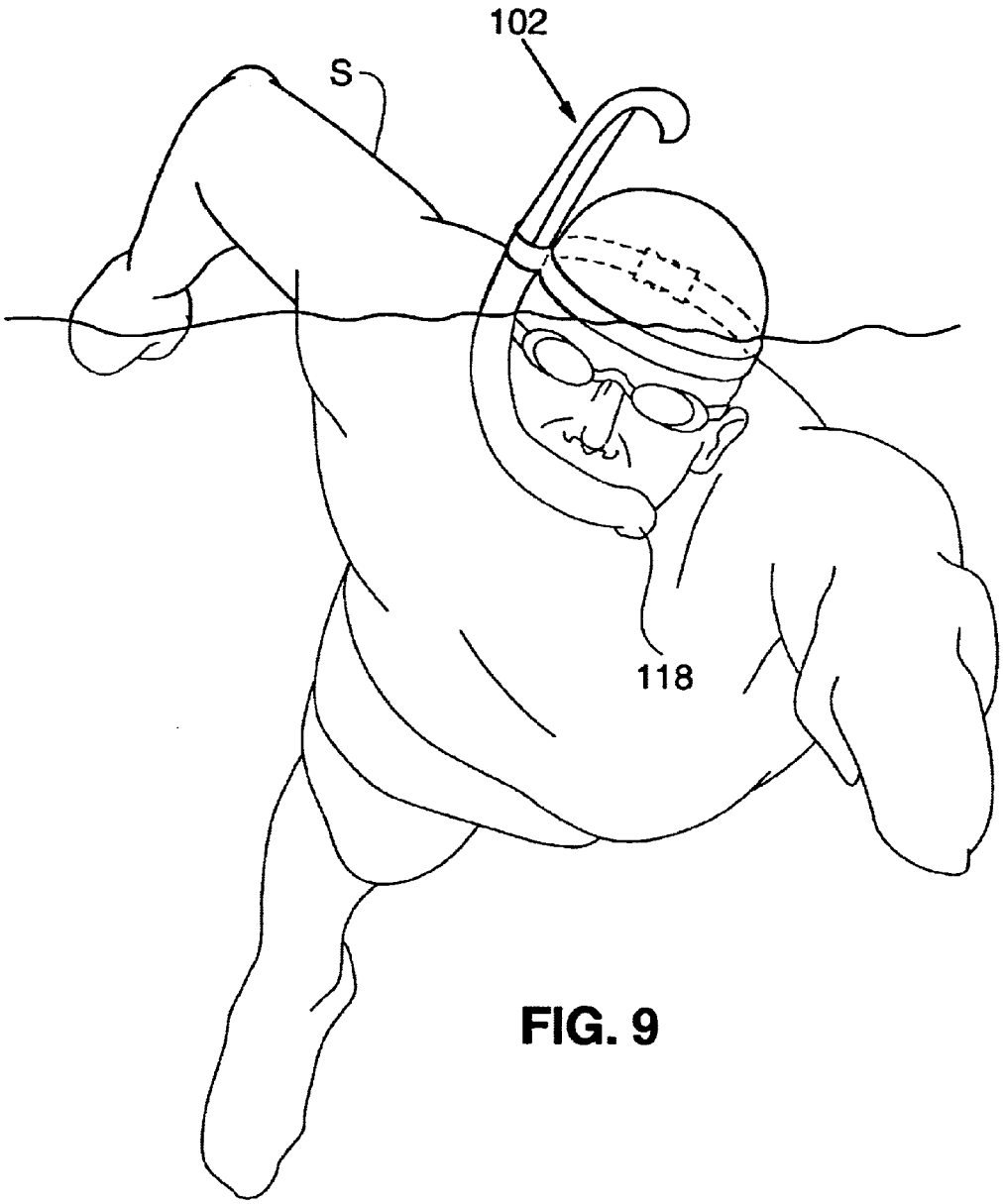
FIG. 9 illustrates the head position of a swimmer wearing the snorkel of FIG. 1A during purging.

FIG. 9 shows a perspective view of snorkel 100 during the act of purging. Swimmer S has rolled such that the recessed purge valve occupies the lowest point of the snorkel. Accumulated water therefore flows to purge valve and is expelled from the snorkel by sharp exhalation.

Although the invention has been described in connection with one specific preferred embodiment, it should be understood that the invention as claimed should not be unduly limited to such specific embodiments. Various other modifications and alterations in the structure and method of operation of the invention will be apparent to those skilled in the art, without departing from the scope of the present invention.

Figure 10:
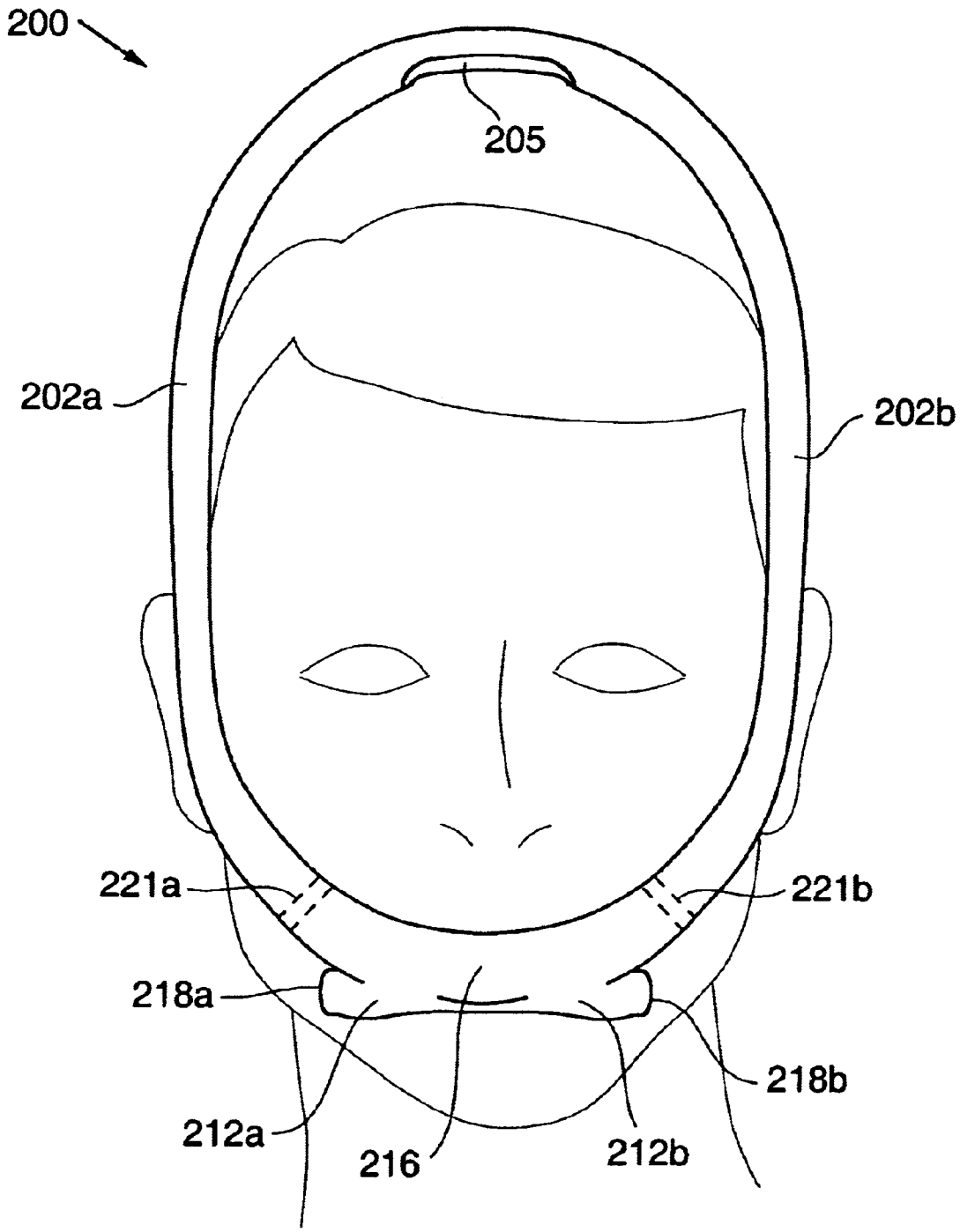
FIGS. 10, 11 and 12 are front perspective views of alternative embodiments snorkels utilizing principles of the present invention, in which the FIGS. 10 and 11 embodiments utilize two breathing tubes, and in which the FIG. 12 embodiment utilizes two breathing tubes having splash-guards.

For example, a second embodiment of the snorkel in accordance with the present invention is illustrated in FIG. 10. The FIG. 10 snorkel 200 includes two breathing tubes 202*a,* 202*b* positioned on either side of the mouthpiece. Each breathing tube 202*a,* 202*b* has the cross-sectional profile of the breathing tube 102 described above in accordance with the first embodiment of the present invention.

Breathing tubes 202*a,* 202*b* are joined at the top of the head to define upper opening 205. Upper opening 205 is oriented to the rear and opens downward over the head of the swimmer. Utilization of a snorkel design in accordance with this second embodiment allows greater airflow to the swimmer and enhanced structural stability for the snorkel.

Snorkel 200 also includes two chambers 212*a,* 212*b,* each chamber including a separate purge valve 218*a,* 218*b* similar to purge valve 118 described above. This feature increases the volume of the drain chamber available to the swimmer, allowing the swimmer to swim for longer periods before having to purge collected water. This feature also directs excess water away from the swimmer's mouth as the swimmer inhales through the mouthpiece.

Snorkel 200 likewise includes a pair of check valves similar to check valve 140 described above with each valve positioned on an opposite side of opening 205.

If desired, snorkel 200 may be configured such that breathing tube 200*a* is an air intake tube, and breathing tube 200*b* is an exhalation tube. A one-way flap valve 221*a* similar to the valve 136 may be positioned within the air intake tube 200*a* to allow air flow into the breathing chamber 216. A second one-way flap valve 221*b* is positioned within exhalation tube 200*b* to allow air flow out of the breathing chamber 216. A variety of other valve configurations may alternatively be used. As with the prior embodiment, a sharp exhalation would close the check valve at the top of the breathing tubes, to cause water to purge through the purge valves 218*a,b*.

Figure 11:
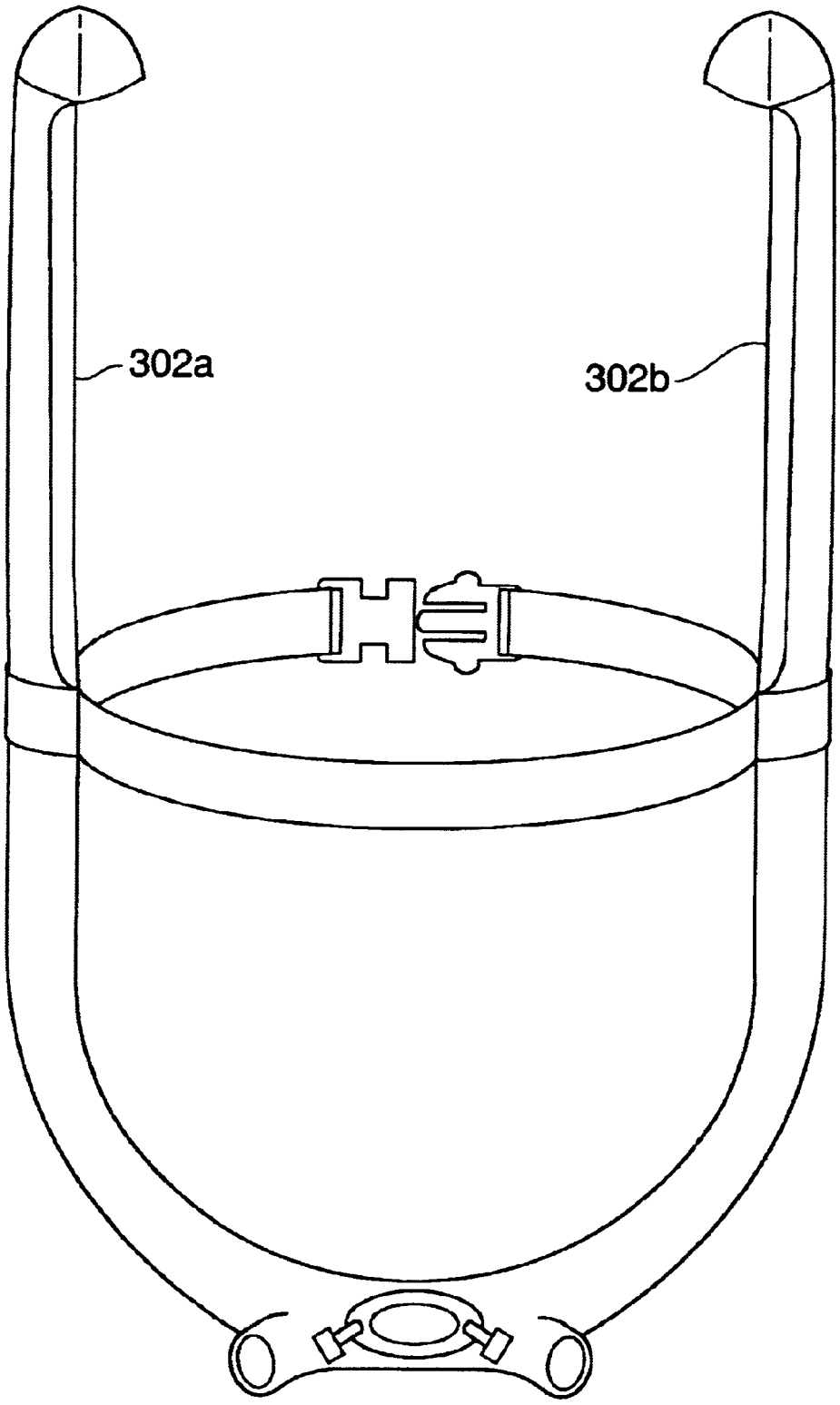
Figure 12:
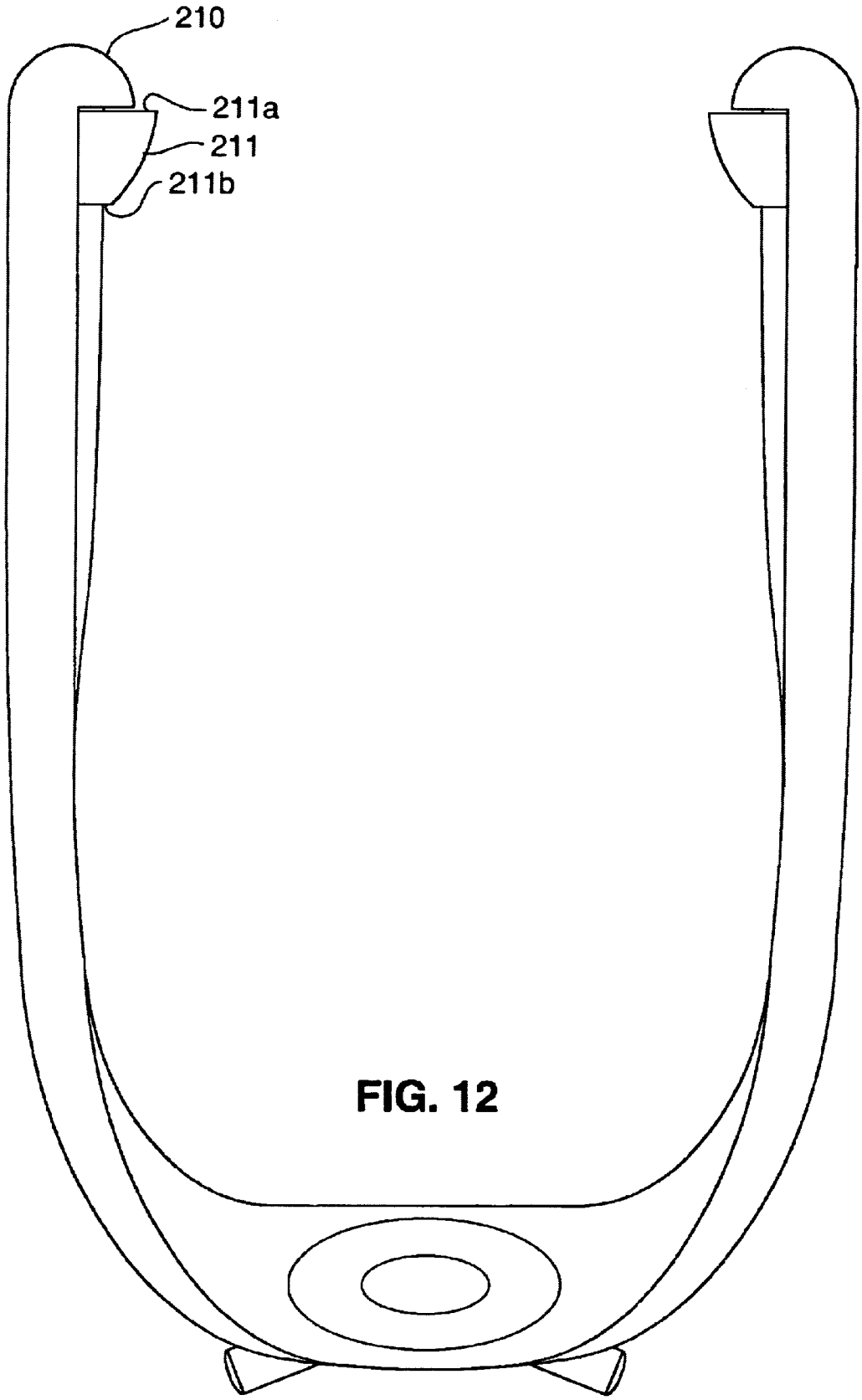

Alternatively, the snorkel may be provided with a pair of separate breathing tubes 302*a,* 302*b* (FIG. 11), each of which is similar to check valve 140 of the first embodiment. A two-breathing tube snorkel may include various ones of the features described herein, such as the valve system described with respect to the FIG. 10 embodiment that causes inhalation through one tube and exhalation through the other tube, and/or the splash guard shown in FIG. 12.

Figure 13:
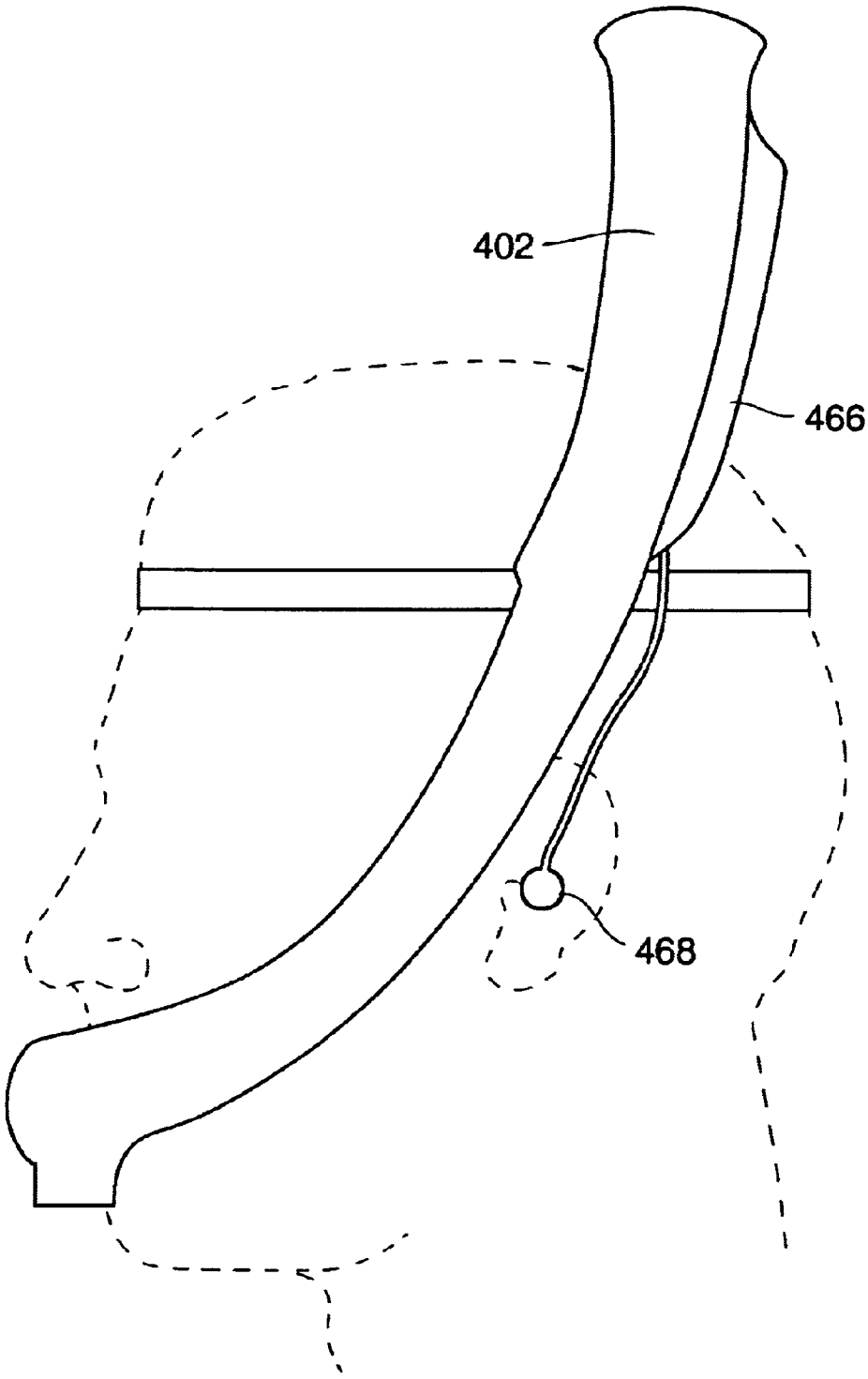
FIG. 13 is a side elevation view illustrating a waterproof radio or midi player on the breathing tube of a snorkel.

Referring to FIG. 13, a waterproof radio and/or midi player 466 may be positioned on breathing tube 402 of the snorkel. The radio may include an AM/FM receiver and/or a receiver enabling the swimmer to receive communications from an instructor or coach via earpieces 468. In the case of a two-breathing-tube embodiment, two such earpieces may be used The term "radio" will be used to mean an AM/FM, wireless receiver, midi player, mini-disk player or similar device used to provide audio to a headset. In a two-breathing-tube embodiment, a housing on the second breathing tube (corresponding to the location of the radio 466 on first breathing tube 402) could store additional batteries for radio 466, allowing for longer periods of use.

I claim:

1. A snorkel, comprising:

an elongate breathing tube having an upper portion and a lower portion, a lower opening formed in the lower portion and an upper opening formed in the upper portion;

a mouthpiece formed at the lower opening;

a one-way valve disposed in the lower portion, the one-way valve oriented to prevent the flow of fluids through the valve into the lower portion, but to permit the flow of gases and fluids through the valve and out of the lower portion;

a check valve disposed in the upper portion, the check valve including a plate pivotable from an open position permitting airflow through the upper opening, and a closed position preventing airflow from the tube through the upper opening; and a spring member contacting the plate, the spring member biasing the plate in the open position.

2. The snorkel of claim 1, wherein the one-way valve includes a second lower opening formed in the lower portion, and a flap connected to the tubular member and extending across the second lower opening.

3. The snorkel of claim 1, wherein the spring member exerts a biasing force against the plate, and wherein the snorkel further includes means for adjusting the biasing force.

4. The snorkel of claim 1, further including a cap connected to the upper portion and extending over the upper opening.

5. The snorkel of claim 1 wherein at least a portion of the breathing tube is formed of a flexible material, the flexible material selected to permit a user to deform the breathing tube to approximately conform to the shape of the user's head.

6. The snorkel of claim 5 wherein the flexible portion of the breathing tube includes a flexible wire element embedded in the flexible material.

7. The snorkel of claim 6 wherein the flexible wire element is a wire mesh.

8. The snorkel of claim 1 further including a second breathing tube, the second breathing tube including a lower portion and an upper portion, the lower portion of the second breathing tube connected to the lower portion of the first breathing tube and the upper portion of the second breathing tube connected to the upper portion of the first breathing tube.

9. The snorkel of claim 8, wherein the lower portion of the second breathing tube including a second one-way valve, the second one-way valve oriented to prevent the flow of fluids into the lower portion, but to permit the flow of gases and fluids out of the lower portion.

10. The snorkel of claim 1, further including a pair of wire members extending from the mouthpiece, the wire members for positioning in a swimmer's mouth during use.

11. The snorkel of claim 1 wherein at least a portion of the breathing tube has a hydro dynamically efficient cross-sectional shape.

12. The snorkel of claim 11 wherein the cross-sectional shape is an air-foil shape.

13. The snorkel of claim 11 wherein the cross-sectional shape is a semi-circular shape.

14. The snorkel of claim 11 wherein the cross-sectional shape is ovular.

15. The snorkel of claim 1 further including a float coupled to the check valve, the float configured to move the check valve to the closed position when the float and upper portion are immersed in water.

16. The snorkel of claim 15 further including a spring latch configured to latch the check valve in the closed position when the check valve is drawn closed by the float.

17. The snorkel of claim 1 further including a splash guard connected to the breathing tube.

18. The snorkel of claim 17 wherein the splash guard includes a cup connected to the breathing tube.

19. The snorkel of claim 8 wherein the first breathing tube is an exhalation tube and the second breathing tube is an inhalation tube, the snorkel further including a one-way exhaust valve positioned to permit air from the lower portion to flow to the exhalation tube, and a one-way inhalation valve positioned to permit air from the inhalation tube to flow to the lower portion.

20. The snorkel of claim 1 further including a strap connected to the breathing tube and attachable to a swimmer's head.

21. The snorkel of claim 1 wherein the strap and the breathing tube are configured for positioning of the breathing tube in approximate alignment with a central axis of a swimmer's face.

22. The snorkel of claim 1, further including a housing attached to the breathing tube, a radio in the housing and a headset coupled to the radio.

23. A method of purging a snorkel during swimming, comprising the steps of:

(a) providing a snorkel including an elongate breathing tube, a check valve in an upper portion of the breathing tube, a one-way valve in a lower portion of the breathing tube, an opening in a lower portion of the snorkel, and a mouthpiece positioned at the opening;

(b) positioning the snorkel on the head of a swimmer, with the swimmer's mouth in contact with the mouth piece and in fluid communication with the opening;

(c) causing the swimmer to inhale and exhale through the mouthpiece, such that inhalation draws into the breathing tube through the check valve and exhalation moves air out of the breathing tube through the check valve;

(d) causing a volume of liquid to accumulate in the breathing tube; and (e) causing the swimmer to forcefully exhale a volume of air, the volume of air closing the check valve to create a back-pressure in the breathing tube, resulting in expulsion of water through the one-way valve.

24. The method of claim 23, wherein the breathing tube is a first breathing tube, wherein the snorkel includes a second breathing tube, and wherein the method includes the steps of causing air inhaled by the swimmer to pass through the first breathing tube and causing air exhaled by the swimmer to pass through the second breathing tube.

25. The method of claim 23, wherein the snorkel includes a splash guard and wherein the method includes the step of blocking movement of water into the breathing tube using the splash guard.

26. The method of claim 25 wherein the splash guard is moveable upon submersion of the snorkel into a closed position minimizing flow of water into the breathing tube.

27. A method of purging a snorkel during swimming, comprising the steps of:

(a) providing a snorkel including an elongate breathing tube, a check valve in an upper portion of the breathing tube and a float coupled to the check valve, a one-way valve in a lower portion of the breathing tube, an opening in a lower portion of the snorkel, and a mouthpiece positioned at the opening;

(b) positioning the snorkel on the head of a swimmer, with the swimmer's mouth in contact with the mouth piece and in fluid communication with the opening;

(c) causing the swimmer to inhale and exhale through the mouthpiece;

(d) causing a volume of liquid to accumulate in the breathing tube;

(e) causing the swimmer to forcefully exhale a volume of air, the volume of air closing the check valve to create a back-pressure in the breathing tube, resulting in expulsion of water through the one-way valve;

and submerging the snorkel, causing the float to close the check valve.

* * * * *